United States Patent [19]

Yamashita et al.

[11] Patent Number: 4,801,368

[45] Date of Patent: Jan. 31, 1989

[54] NI/SN CATHODE HAVING REDUCED HYDROGEN OVERVOLTAGE

[75] Inventors: Hiroya Yamashita; Takeshi Yamamura, both of Tokuyama; Katsutoshi Yoshimoto, Kudamatsu, all of Japan

[73] Assignee: Tokuyama Soda Kabushiki Kaisha, Yamaguchi, Japan

[21] Appl. No.: 80,164

[22] Filed: Jul. 30, 1987

Related U.S. Application Data

[63] Continuation of Ser. No. 795,114, Nov. 5, 1985, abandoned.

[30] Foreign Application Priority Data

Nov. 8, 1984 [JP] Japan ..... 59-234155

[51] Int. Cl.[4] ..... C25B 1/14

[52] U.S. Cl. ..... 204/293; 204/44.4; 204/44.5; 204/112; 204/120; 204/123; 313/358

[58] Field of Search ..... 204/44.4, 44.5, 54.1, 204/54.5, 49, 112, 120, 123, 291, 292, 293; 313/358

[56] References Cited

U.S. PATENT DOCUMENTS

| | | | |
|---|---|---|---|
| 4,127,468 | 11/1978 | Alfenaar et al. | 204/293 X |
| 4,140,840 | 2/1979 | Ruben | 429/190 |
| 4,181,585 | 1/1980 | Pangborn | 204/98 |
| 4,188,464 | 2/1980 | Adams et al. | 429/210 |
| 4,423,122 | 12/1983 | Iacovangelo et al. | 204/293 X |
| 4,486,278 | 12/1984 | Oda et al. | 204/290 R |
| 4,496,442 | 1/1985 | Okazaki et al. | 204/294 |
| 4,530,742 | 7/1985 | Carlin et al. | 427/229 X |

FOREIGN PATENT DOCUMENTS

| | | | |
|---|---|---|---|
| 112835 | 10/1974 | Japan | 204/290 R |
| 112785 | 9/1979 | Japan | 204/290 R |
| 2598681 | 3/1981 | Japan | 204/293 |
| 25986 | 3/1981 | Japan | 204/293 |
| 133484 | 10/1981 | Japan | 204/290 R |
| 207183 | 12/1982 | Japan | 204/290 R |
| 208091 | 11/1984 | Japan | 204/290 R |

OTHER PUBLICATIONS

Practical Surface Technology, vol. 30, No. 4, pp. 132–138.

Journal of the Electrochemical Society, vol. 125, No. 3, pp. 107–119.

Journal of the Electrochemical Society, vol. 125, No. 2, pp. 330–339.

*Primary Examiner*—David K. Moore

*Assistant Examiner*—Mark R. Powell

*Attorney, Agent, or Firm*—Sherman and Shalloway

[57] ABSTRACT

Disclosed is a cathode comprising an active layer composed of a nickel/tin alloy having a nickel content of 25 to 99% by weight, which is formed on the surface of an electrically conductive electrode substrate. When this cathode is used for generating hydrogen by the electrolysis, the hydrogen overvoltage is controlled to a very low level. This active layer is formed by co-electrodeposition of Ni and Sn from a plating solution containing Ni and Sn ions or by thermal decomposition of a mixture containing a nickel compound and a tin compound.

19 Claims, 2 Drawing Sheets

NI/SN CATHODE HAVING REDUCED HYDROGEN OVERVOLTAGE

This application is a continuation of application Ser. No. 795,114 filed Nov. 5, 1985.

BACKGROUND OF THE INVENTION (1) Field of the Invention

The present invention relates to a novel cathode suitable for generating hydrogen, which is used as the cathode for the electrolysis of sodium chloride, water or the like, and a process for the fabrication of this novel cathode.

(2) Description of the Prior Art

The technique of obtaining chlorine and sodium hydroxide by the electrolysis of an aqueous solution of an alkali metal salt, especially by the electrolysis of an aqueous solution of sodium chloride according to the process using an ion exchange membrane, has recently been advanced, and the electrolysis at a higher current efficiency and a lower voltage, that is, the improvement of the power efficiency, is eagerly desired. Of this technical trend, the improvement of the current efficiency is achieved mainly by improving the ion exchange membrane and the reduction of the operation voltage is achieved by reducing the overvoltage while improving the ion exchange membrane. In connection with the anode, many excellent proposals have already been made, and electrodes in which the problem of the anode overvoltage is of no substantial significance have been used on an industrial scale.

Electrodes formed of soft iron or nickel are industrially used as the cathode, that is, the electrode for generating hydrogen, and since such a high hydrogen overvoltage as about 400 millivolts is allowed in these cathodes, it is pointed out that reduction of this overvoltage is necessary.

Various means for reducing the hydrogen overvoltage have been recently proposed in patent specifications. For example, Japanese Patent Application Laid-Open Specifications No. 164491/80, No. 131188/80, No. 93885/81 and No. 167788/83 propose fine particle fixed type electrodes in which particles of nickel, cobalt, silver or an alloy thereof with aluminum or other metal are fusion-bonded to an electrode substrate, or these particles are embedded in a retaining metal layer formed of silver, zinc, magnesium or tin so that the particles are partially exposed and if desired, a part of the retaining metal layer is chemically corroded to render the metal layer porous. Furthermore, Japanese Patent Application Laid-Open Specification No. 60293/79 proposes a hydrogen generating electrode in which the hydrogen overvoltage is reduced by an active metal electrodeposition process where electro-plating is conducted on an electrode substrate by using a plating solution comprising a sulfur-containing nickel salt.

Cathodes having a relatively small hydrogen overvoltage may be fabricated according to these proposals. However, further improvements are desired for further reducing the overvoltage, increasing the durability of the cathode performance and decreasing the manufacturing cost. For example, the fine particle fixed type electrode is generally defective in that the metal constituting fine particles is expensive, the preparation of fine particles is difficult, the electrode fabrication process is complicated, the deviation of the electrode performance is great and the performance stability is low.

Moreover, the electroplating process using a sulfur-containing nickel solution is defective in that it is difficult to sufficiently reduce the hydrogen overvoltage.

SUMMARY OF THE INVENTION

It is therefore a primary object of the present invention to provide an electrode suitable for generating hydrogen, which can be fabricated by very simple means by using relatively inexpensive starting materials and in which the hydrogen overvoltage is reduced, for example, to a level lower than 200 millivolts, especially lower than 120 millivolts, at a current density of 30 $A/dm^2$, and the performance is stable for a long time.

According to the present invention, this object is attained by applying a specific plating to an electrode substrate to form a layer of an active substance. More specifically, in accordance with the present invention, there is provided a cathode comprising an electrically conductive electrode substrate and an active layer of an alloy of nickel and tin formed on the substrate, wherein the nickel content in the active layer is 25 to 99% by weight.

BRIEF DESCRIPTION OF THE DRAWINGS

FIG. 3 is a scanning electron micrograph of the active layer of the electrode.

DETAILED DESCRIPTION OF THE PREFERRED EMBODIMENTS

Figure 1:
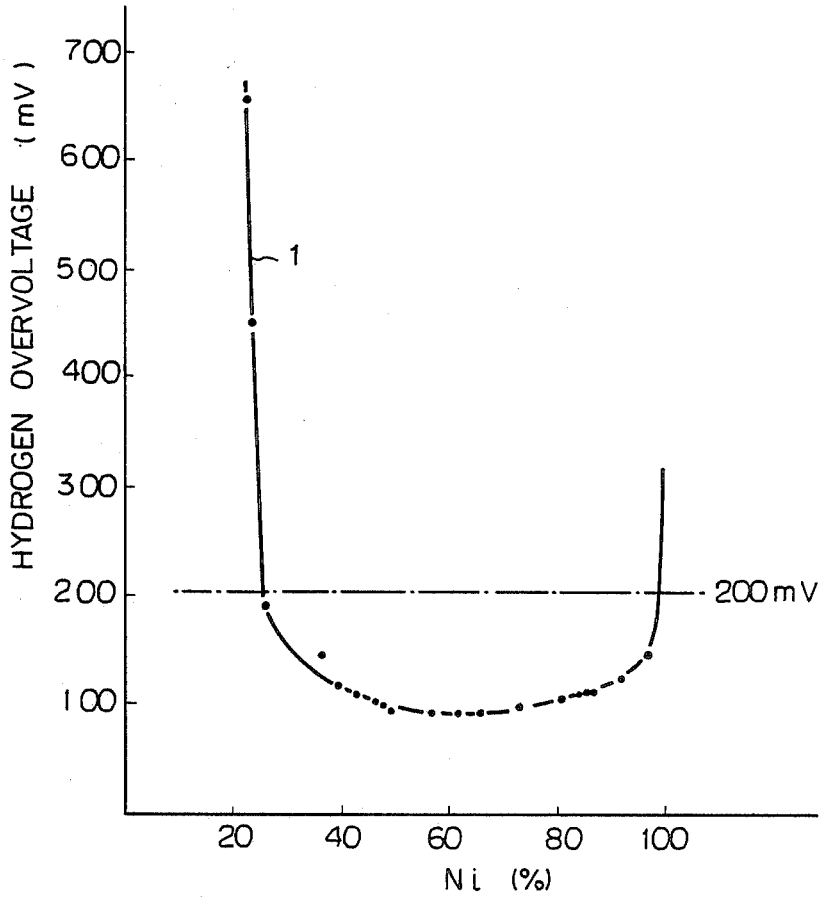
FIG. 1 is a graph illustrating the relation between the nickel content in the electrodeposition product and the hydrogen overvoltage.

An electrically conductive substance may be used for the electrode substrate in the present invention, and a metal having a durability in the environment where a cathode is used is ordinarily used as the electrode substrate. Accordingly, when the cathode is used for the electrolysis of an alkali metal salt, especially an alkali metal halide, or the electrolysis of water, it is preferred that soft iron or nickel be used as the electrode substrate. However, a highly electrically conductive metal such as copper or a copper alloy, or titanium or the like may also be used in some cases.

The shape of the electrode is determined by the shape of the electrode substrate, and the shape of the electrode is not particularly critical in the present invention. Ordinarily, a shape adopted for a cathode customarily used for an electrolytic cell is used. For example, a plate shape, a net shape, a punched metal shape, an expanded metal shape or a reed screen shape may be adopted.

In the present invention, the means for forming an active layer on the electrode substrate is not particularly critical. However, electro-plating is most preferred, and means for depositing a nickel/tin alloy by heating and decomposing a mixture containing a nickel compound and a tin compound on the electrode substrate comes next.

In case of either electro-plating or heating decomposition plating, customary preliminary treatments such as degreasing and etching may be preferably performed on the substrate prior to the plating operation. Furthermore, there may be adopted a process in which a sulfur-containing plating layer is formed by using a sulfur compound such as nickel rhodanide before formation of a nickel/tin alloy layer according to the present invention. Moreover, as another effective means, there can be mentioned a process in which electrically conductive or non-conductive particles, especially fine particles having a particle size of 0.05 to 50μ, such as particles of a metal, for example, chromium, molybdenum, tungsten, vanadium, niobium, tantalum, titanium, iron, cobalt, nickel or silver, a carbide, for example, tungsten carbide, silicon carbide, boron carbide, zirconium carbide, titanium carbide, hafnium carbide, niobium carbide, tantalum carbide, graphite or vanadium carbide, a boride, for example, iron boride or nickel boride, or a nitride, for example, vanadium nitride, niobium nitride or titanium nitride, are deposited on the surface of the substrate to roughen the substrate surface and increase the surface area, as taught in Japanese Patent Application Laid-Open Specification No. 133484/81 or No. 207183/82, and in combination with this deposition of particles or separately therefrom, a metal of the group VIII of the periodic table is plated on the surface of the substrate, and then, a nickel/tin alloy is plated according to the present invention. Ordinarily, the deposition of particles can be accomplished by electroplating using a plating solution of silver or a metal of the group VIII of the periodic table containing particles as mentioned above. In this case, a known plating solution may be used without any limitation. However, a plating solution of silver or a metal of the group VIII of the period 4 of the periodic table, such as nickel, iron or cobalt is preferred. As the nickel plating solution, there can be mentioned a Watt bath, a nickel black bath and a nickel complex bath, and as the silver plating bath, there can be used a silver cyanide solution. When these plating solutions are used, the plating conditions are appropriately selected. It is generally preferred that electrically conductive particles or non-conductive particles be suspended in a metal plating solution at a concentration of 1 to 1000 g/l and the plating conditions be selected so that the content of the conductive or non-conductive particles in the plating layer formed on the electrode substrate is 2 to 50% by volume. Thus, a porous substance layer having convexities and concavities is formed on the surface of the electrode substrate. This porous substance layer increases the surface area of the electrode, and when a cathode active substance is formed by the thermal decomposition method, the porous substance layer facilitates impregnation with a solution of a mixture of a nickel compound and a tin compound and exerts an effect of tightly bonding the plating layer. Moreover, the porous substance layer has an effect of inhibiting the growth of a crystal of the active substance.

The method for forming the porous substance layer on the electrode substrate is not limited to the above-mentioned plating method. For example, electrically conductive or non-conductive particles may be fixed onto the electrode substrate by such means as flame spraying. The thickness of the porous substance layer is not particularly critical, but in order to obtain a cathode having a lower hydrogen overvoltage, it is preferred that the thickness of the porous substance layer be larger than the thickness of the active layer formed by the plating of the active substance.

The layer of the alloy containing nickel and tin at a specific ratio, which is the active substance to be made present on the surface of the electrode substrate, need not cover the entire surface of the electrode substrate, but in order to increase the effective surface area of the electrode, it is preferred that the entire surface be covered with the alloy layer. In the case where copper is used as the electrode substrate and there is a risk of corrosion of the substrate in the cathode-using atmosphere, the entire surface of the substrate (the entire surface of the portion to be immersed in the solution) should be covered with the alloy layer. In the present invention, the composition of the active layer to be made present on the surface of the electrode substrate is very important for the hydrogen overvoltage. The active layer is composed of an alloy comprising at least nickel and tin. Addition of a third component for increasing the surface area to nickel and tin is effective. Furthermore, the alloy may contain other element or compound which is unavoidably included. In the active layer, the ratio between nickel (Ni) and tin (Sn), that is, $$\frac{Ni}{Ni + Sn} \times 100(\%),$$

should be 25 to 99% by weight. If the nickel content deviates from this range, the hydrogen overvoltage is surprisingly increased.

A series of samples were prepared by using an expanded metal of soft iron as the substrate and a pyrophosphoric acid bath as the plating solution and plating a nickel/tin alloy, where the nickel content was changed by changing the ratio of the nickel ion concentration to the tin ion concentration in the plating bath and the current density. With respect to each of these samples, the hydrogen overvoltage was measured at 90° C. in 11N NaOH at a current density of 30 A/dm$^2$. The relation as shown in Table 1 was obtained between the nickel content (%) based on the sum of weights of nickel and tin in the electrodeposition product and the hydrogen overvoltage. This relation is illustrated in FIG. 1 of the accompanying drawings.

TABLE 1

| Ni Content (%) | Hydrogen Overvoltage (mV/dm$^2$) |
|---|---|
| 22 | 655 |
| 23 | 450 |
| 25 | 190 |
| 27 | 180 |
| 36 | 145 |
| 40 | 115 |
| 42 | 110 |
| 46 | 105 |
| 48 | 100 |
| 54 | 95 |
| 57 | 95 |
| 62 | 95 |
| 66 | 95 |
| 73 | 100 |
| 81 | 105 |
| 84 | 110 |
| 86 | 110 |
| 90 | 120 |
| 91 | 120 |
| 92 | 125 |
| 97 | 145 |
| 100 | 250 |

In FIG. 1, curve 1 illustrates the relation between the above-mentioned nickel content and the hydrogen overvoltage. It is understood that the reduction of the hydrogen overvoltage below 200 mV, which is one object of the present invention, is attained when the nickel content is about 25 to about 99%, though the effect is not stable in the boundary portion, and that the nickel content is preferably in the range of 35 to 95% and a cathode having a surprisingly low hydrogen overvoltage is obtained when the nickel content is 45 to 80%. The reasons why the hydrogen overvoltage is thus reduced in case of an alloy having a specific proportion between nickel and tin has not been completely elucidated. However, it is construed that if nickel and tin are coprecipitated in a specific proportion, they adhere to the substrate in a special crystal or state and this deposition condition brings about a low hydrogen overvoltage. When the state of the adhering substance is observed by a microscope, it is often found that the adhering substance takes the form resembling the form of piled pebbles. Furthermore, a very broad peak appears in the X-ray diffraction pattern and the crystal distortion or the presence of crystallites is considered, and it is construed that the crystal distortion or the presence of crystallites has a relation to the activity.

As preferred means for the fabrication of the cathode of the present invention, there can be mentioned a process of the electric plating of a nickel/tin alloy using a plating solution containing a nickel compound and a tin compound, and an alloy plating process of the deposition of nickel and tin by thermally decomposing a mixture containing a nickel compound and a tin compound. Such means as flame spraying can also be adopted.

The electric plating process is preferred because cathodes can be prepared with a good reproducibility. The thermal decomposition process is advantageous in that cathodes of the present invention can be fabricated at a high productivity. These preparation processes will now be described.

In the case where the cathode of the present invention is prepared according to the electro-plating process, since there is a difference of the reduction potential between nickel and tin ions, if electrodeposition is carried out on the substrate in the presence of both the ions, only the tin ion is selectively reduced and deposition of nickel is started when the tin ion in the plating solution is substantially consumed. In this case, an alloy is not substantially formed, but the metals are deposited in two layers. If the resulting product is used as the cathode, the hydrogen overvoltage is very high and exceeds 400 mV.

Accordingly, in order to form a nickel/tin alloy layer by the electric plating, it is necessary to bring the reduction potential of both the ions close to each other. For this purpose, it is necessary to lower the reduction potential of the tin ion and/or elevate the reduction potential of the nickel ion by using various complexing agents. For example, in *Metal Surface Technique,* 32, No. 1 (1981), page 23, plating of a tin/nickel alloy in a pyrophosphoric acid bath is studied and it is taught that addition of various amino acids is effective. Namely, many amino acids, especially α-amino acids such as glycine, shift the deposition potential of nickel in the plating solution toward the anodic side. Furthermore, when a plating solution containing a fluoride as the main component, as disclosed in *Journal of Electrochemical Society,* 100, page 107 (1953), is used, a complex of the fluoride and $Sn^{2+}$ is formed and this complex shifts the deposition potential of $Sn^{2+}$ toward the cathodic side to bring the deposition potential of $Sn^{2+}$ close to the nickel deposition potential. It is expected that chlorides will exert a similar effect. Furthermore, amines such as pyridine, pyrazole and ethylene diamine, hydroxycarboxylic acids such as citric acid and tartaric acid, salts thereof, sulfur-containing compounds such as thiourea and xanthic acid, hydroxy-sulfonic acids such as cresol-sulfonic acid, salts thereof, and aminosulfonic acids such as sulfamic acid and salts thereof are effective. Among these complexing agents, amino acids such as glycine, α-alanine, β-alanine, valine, aspartic acid, glutamic acid, alginic acid, lysine, histidine, proline, serine and threonine, and ethylene diamine are especially effective, and soluble fluorides such as sodium fluoride, hydrofluoric acid, sodium chloride and hydrochloric acid come next. However, as is apparent from the foregoing description, in the present invention, any of complexing agents capable of forming with nickel and/or tin a complex bringing deposition potential of nickel and tin close to each other can be used without any limitation. The amount used of the complexing agent is not particularly critical, but it is ordinarily sufficient if the complexing agent is used in an amount of 0.1 to 5 moles, preferably 0.5 to 3 moles, per mole of the complex-forming metal ion.

As the nickel compound forming a nickel ion in the plating solution, any of soluble nickel salts may be used without any limitation. For example, there can be mentioned nickel chloride ($NiCl_2.6H_2O$), nickel sulfate ($NiSO_4.6H_2O$), nickel nitrate ($Ni(NO_3)_2.6H_2O$), nickel bromide ($NiBr_2.3H_2O$), nickel acetate ($Ni(CH_3COO)_2.4H_2O$), nickel ammonium sulfate ($(NH_4)Ni(SO_4)_2.6H_2O$), nickel sulfamate ($Ni(NH_2SO_3)_2.4H_2O$), nickle lactate ($Ni(HCOO)_2.2H_2O$) and nickel benzene sulfate ($Ni(C_6H_5SO_3).6H_2O$). Among them, nickel sulfate and nickel chloride are most popular.

A soluble tin salt may be used without any limitation as the tin compound for forming a tin ion. For example, there can be mentioned stannous chloride ($SnCl_2.2H_2O$), stannous nitrate ($Sn(NO_3)_2.2H_2O$), stannous sulfate ($SnSO_4$), stannous pyrophosphate and stannic sulfate ($Sn(SO_4)_2.H_2O$). Among them, stannous pyrophosphate and stannous chloride are ordinarily used.

Some examples of the composition of the plating solution suitably used in the present invention are shown in Tables 2 through 4.

TABLE 2

| Ingredients | Bath Composition |
|---|---|
| Stannous pyrophosphate | 10 g/l |
| Nickel chloride | 24 g/l |
| Potassium pyrophosphate | 231 g/l |
| Ammonium citrate | 16 g/l |

TABLE 3

| Ingredients | Bath Composition |
|---|---|
| Stannous chloride ($SnCl_2.2H_2O$) | 0.063 mole/l |
| Nickel chloride($NiCl_2.2H_2O$) | 0.125 mole/l |
| Potassium pyrophosphate | 0.5 mole/l |
| Glycine | 0.5 mole/l |

TABLE 4

| Ingredients | Composition (a) | Composition (b) | Composition (c) |
|---|---|---|---|
| $SnCl_2.2H_2O$ | 30 g/l | 30 g/l | 30 g/l |
| $NiCl_2.6H_2O$ | 300 g/l | 300 g/l | 300 g/l |
| NaCl | 132 g/l | 132 g/l | 132 g/l |
| HCl | 10 vol. % | 10 vol. % | 10 vol. % |
| cresol-sulfonic acid | — | 5 g/l | 5 g/l |
| Sodium naphthalene-disulfonate | — | — | 0.075 g/l |
| Thiourea | — | 0.075 g/l | — |

Figure 2:
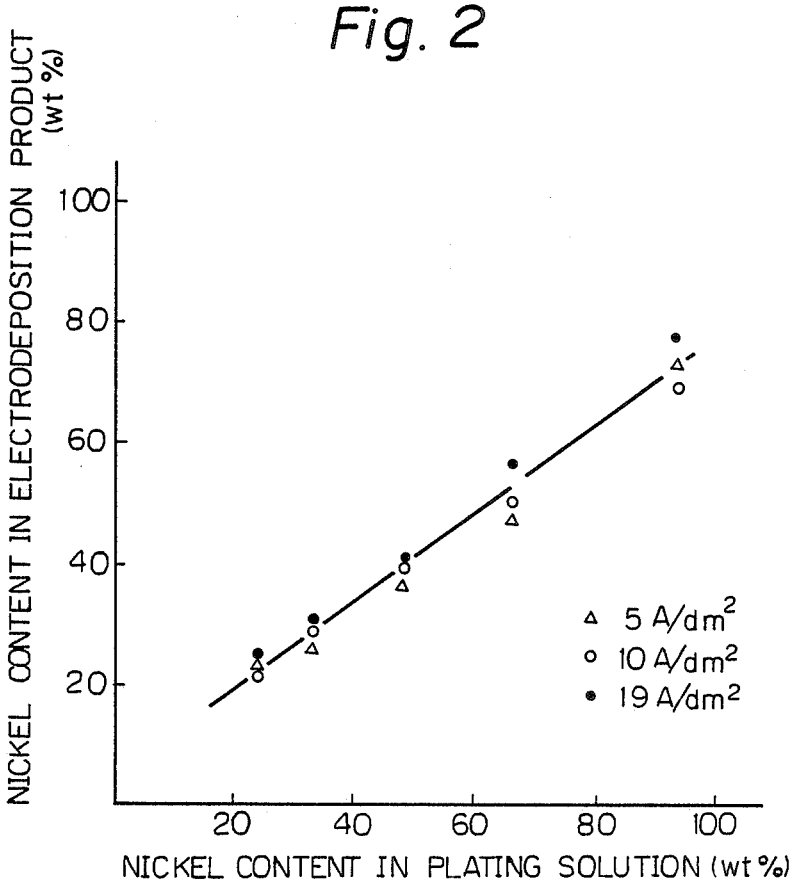
FIG. 2 is a graph illustrating the relation between the nickel content in the plating solution and the nickel content in the electrodeposition product.

These examples are of the plating solution to be used for the fabrication of the cathode of the present invention. The desired nickel content can be attained by changing the proportion between nickel and tin ions in the plating solution. More specifically, in order to increase the nickel content in the coating layer electrodeposited on the substrate, it is necessary to increase the nickel ion concentration in the bath relatively to the tin ion concentration. The relation between the bath composition and the nickel content in the electro-deposited coating layer is changed by the kinds and amount of the complexing agent and other additives. For example, when the weight ratio between $SnCl_2$ and $NiCl_2$ is changed in the pyrophosphoric acid bath, as shown in FIG. 2, a substantially proportional relation is established between the nickel content (%) in the plating bath ($Ni \times 100/(Ni+Sn)$) and the nickel content (%) in the electro-deposition product. FIG. 2 shows the results obtained when the nickel-to-tin ratio was changed by changing the amount of tin ($SnCl_2.2H_2O$) in a plating solution comprising 200 g/l of potassium pyrophosphate, 20 g/l of glycine and 30 g/l of nickel ($NiCl_2.2H_2O$). The plating was carried out at a pH value of 8 at 50° to 60° C. The above relation is somewhat changed also by the pH value of the bath, the temperature and the current density. The relation can be easily known by checking these factors preliminarily in advance.

Incidentally, in order to keep the tin ion stable in the plating solution, it is preferable to add phosphoric acid, especially pyrophosphoric acid or a salt thereof, to the plating solution.

The electro-plating conditions are not substantially different from those of ordinary decorative or anti-corrosive tin/nickel alloy plating, but in order to obtain the intended active coating for the cathode of the present invention, it is ordinarily necessary that the nickel content should be higher than in the decorative or anticorrosive plating. Accordingly, the molar ratio Sn/Ni between the tin and nickle ion concentrations in the plating bath is adjusted to not more than 2, ordinarily from $10^{-4}$ to 2, preferably from 0.001 to 1.

The pH value of the plating solution is 5 to 10, preferably 6 to 9, when the nickel complex is mainly formed, and when the tin complex is mainly formed, the pH value is adjusted to a lower level, for example, 1 to 6, preferably 1 to 4, especially about 3. The pH value is adjusted by selecting the kind and amount of the complexing agent or other additive, or, if necessary, by adding an acid such as hydrochloric acid, phosphoric acid or hydrofluoric acid or an alkali such as sodium carbonate, sodium hydroxide or aqueous ammonia. Of course, use of a buffer solution as the spinning bath is sometimes preferred.

The plating is ordinarily carried out at a current density of 0.1 to 30 $A/dm^2$. In order to obtain a good performance, when the molar ratio Sn/Ni of the tin ion to the nickel ion is small in the plating bath, the current density should be low, and when the above molar ratio is large, the current density should be high.

The thickness of the coating layer formed on the electrode substrate by the electro-deposition is not particularly critical, but if the thickness is too small, the effect is small and if the thickness is too large, the coating tends to fall down. Accordingly, the thickness is ordinarily 0.1 to 150μ and preferably 15 to 100μ.

In the case where the cathode of the present invention is prepared by the thermal decomposition process, an inorganic compound of nickel and/or tin such as a chloride, a bromide, an iodide or a nitrate, or an organic metal compound of nickel and/or tin such as a formate or an acetate may be used. Ordinarily, a mixture of compounds as mentioned above is dissolved in a solution, and according to need, a tackifier composed of a polymeric substance such as polyvinyl alcohol or agar or a surface active agent may be used for incorporation of the above-mentioned electrically conductive or non-conductive particles. As the medium, there may be ordinarily used water, alcohols such as ethanol and butanol, benzene, and other polar or non-polar solvents. The nickel and tin compounds are used in such amounts that the amount of nickel precipitated by the thermal decomposition at the subsequent step is 25 to 99% by weight, preferably 35 to 99% by weight, especially preferably 40 to 80% by weight, based on the sum of nickel and tin precipitated by the thermal decomposition. Each of the nickel and tin compounds is ordinarily dissolved or suspended at a concentration of 0.5 to 15% by weight. The resulting solution or suspension is coated on the electrode substrate, preferably on the above-mentioned porous substance layer, and the thermal decomposition is then effected by heating to precipitate a nickel/tin alloy. The method for coating the solution of the mixture is not particularly critical, and such means as spraying, brush coating and dip coating may be adopted. the thermal decomposition is ordinarily accomplished by carrying out heating in an atmosphere of an inert gas such as nitrogen or a reducing atmosphere of hydrogen or the like in the absence of oxygen at 200° to 800° C., preferably 300° to 550° C., especially preferably 400° to 450° C., for about 15 minutes to about 3 hours, whereby a specific nickel/tin alloy is deposited and sintered on the electrode substrate. It is preferred that even after the termination of the thermal decomposition, the oxygen-free atmosphere be maintained until the temperature of the substrate is lowered below 100° C. The thermal decomposition in an oxidizing atmosphere (in the presence of oxygen) is not preferred because the electrode performance is degraded.

Ordinarily, the coating and thermal decomposition of the mixture of the nickel compound and tin compound are repeated several times to scores of times so that the thickness of the active layer formed by sintering the coating layer of the nickel/tin alloy deposited by the thermal decomposition is 0.001 to 150μ, preferably 0.1 to 150μ, especially preferably 0.1 to 3μ.

Instead of the above-mentioned coating and sintering method, there may be adopted a method in which a nickel/tin alloy comprising 25 to 99% by weight of nickel is deposited on the porous substance layer by such means as flame spraying.

In the cathode of the present invention, by forming a coating layer of an active substance composed of a nickel/tin alloy having a nickel content of 25 to 99% by weight on the surface of an electrode substrate composed of a substance having an electric conductivity, preferably a metal such as iron, nickel or an alloy thereof, by nickel/tin alloy plating, the hydrogen overvoltage can be reduced to a very low level, for example, to 100 mV or lower when water is electrolyzed at 90° C. at a current density of 30 $A/dm^2$ by using a 11N aqueous solution of sodium hydroxide. The reason why this functional effect is attained in the cathode of the present invention has not been completely elucidated, but it is construed that by incorporating tin into nickel, distortion is generated in nickel crystals or formation of crystallites is caused, and these distorted crystals or crystallites bring about a functional effect of surprisingly reducing the hydrogen overvoltage when the nickel/tin alloy-deposited substrate is used as the cathode.

The present invention will now be described in detail with reference to the following examples that by no means limit the scope of the invention.

EXAMPLES 1 THROUGH 3

An expanded metal (SW=3 mm, LW=6 mm, thickness=1.5 mm) of soft iron was degreased and etched, and the expanded metal was plated by electro-plating at an electricity quantity of 7200 coulomb and a current density shown in Table 6 in a plating solution shown in Table 5 by using a Ti-Pt electrode as the anode.

TABLE 5

| | |
|---|---|
| $SnCl_2.2H_2O$ | 7 g/l |
| $NiCl_2.6H_2O$ | 30 g/l |
| $K_4P_2O_7$ | 200 g/l |
| $NH_2CH_2COOH$ | 20 g/l |
| pH value | 8 ($NH_4OH$) |
| Temperature | 50 to 60° C. |

The hydrogen overvoltage of the obtained electrode was measured at 90° C. at a current density of 30 A/dm$^2$ in 11N NaOH. The obtained results are shown in Table 6. Furthermore, the thickness of the active substance layer of each electrode was directly measured from the section of the electrode, and the nickel content in the active substance layer was determined according to the dimethylglyoxime method. The obtained results are shown in Table 6.

TABLE 6

| Example No. | Plating Current Density (A/dm$^2$) | Hydrogen Overvoltage (mV) | Thickness (μ) of Active Layer | Ni Content (%) |
|---|---|---|---|---|
| 1 | 5 | 120 | 30 | 47 |
| 2 | 10 | 105 | 23 | 49 |
| 3 | 19 | 120 | 20 | 56 |

EXAMPLES 4 THROUGH 6

The procedures of Examples 1 through 3 were repeated in the same manner except that the concentration of $SnCl_2.2H_2O$ was changed to 1 g/l. The obtained results are shown in Table 7.

TABLE 7

| Example No. | Plating Current Density (A/dm$^2$) | Hydrogen Overvoltage (mV) | Ni Content (%) |
|---|---|---|---|
| 4 | 5 | 105 | 74 |
| 5 | 10 | 110 | 69 |
| 6 | 19 | 130 | 83 |

EXAMPLE 7

The plating operation was carried out at a current density of 0.5 A/dm$^2$ and an electricity quantity of 7200 coulomb in the same manner as described in Examples 1 through 3 except that pyrophosphoric acid was not added and the concentration of $SnCl_2.2H_2O$ was changed to 0.1 g/l. The hydrogen overvoltage of the obtained electrode was 140 mV. The Ni content in the active layer was 96%.

EXAMPLE 8

The plating operation was carried out at a current density of 10 A/dm$^2$ and an electricity quantity of 7200 coulomb in a plating solution shown in Table 8 in the same manner as described in Examples 1 through 3.

TABLE 8

| | |
|---|---|
| $SnCl_2.2H_2O$ | 10 g/l |
| $NiCl_2.6H_2O$ | 300 g/l |
| $NH_4HF_2$ | 40 g/l |
| $NH_4OH$ | 35 ml |
| Bath temperature | 70° C. |

When the hydrogen overvoltage of the obtained electrode was measured at 30 A/dm$^2$ at 90° C. in 11N NaOH, it was found that the hydrogen overvoltage was 105 mV. The Ni content in the active substance was 56%.

EXAMPLES 9 AND 10

The plating operation was carried out at a current density of 0.5 A/dm$^2$ and an electricity quantity of 25000 coulomb in a plating solution shown in Table 9 in the same manner as described in Examples 1 through 3. The hydrogen overvoltage was measured at 90° C. at 30 A/dm$^2$ in 11N NaOH. In each electrode, the hydrogen overvoltage was 95 mV. The Ni content in the active substance was 62% (Example 9) or 65% (Example 10).

TABLE 9

| | Example 9 | Example 10 |
|---|---|---|
| $SnCl_2.2H_2O$ | 20 g/l | 20 g/l |
| $NiCl_2:6H_2O$ | 300 g/l | 300 g/l |
| NaCl | 130 g/l | 130 g/l |
| HCl | 10 vol. % | 10 vol. % |
| Cresol-sulfonic acid | 5 g/l | |
| Sodium 1,5-naphthalene-disulfonate | | 5 g/l |
| Thiourea | 0.08 g/l | 0.08 g/l |
| Bath temperature | 65° C. | 65° C. |

COMPARATIVE EXAMPLE 1

The hydrogen overvoltage was measured in the same manner as described in Examples 1 through 3 except that the concentration of $SnCl_2.2H_2O$ was changed to 42 g/l. The obtained results are shown in Table 10.

TABLE 10

| Plating Current Density (A/dm$^2$) | Hydrogen Overvoltage (mV) | Ni Content (%) |
|---|---|---|
| 5 | 700 | 24 |
| 10 | 675 | 22 |
| 19 | 375 | 23 |

COMPARATIVE EXAMPLE 2

The plating operation was carried out in the same manner as described in Example 8 except that the concentration of $SnCl_2.2H_2O$ was changed to 70 g/l. The hydrogen overvoltage of the obtained electrode was 410 mV as measured at 90° C. and 30 A/dm$^2$ in 11N NaOH. The Ni content in the active substance was 23%.

COMPARATIVE EXAMPLE 3

The plating operation was carried out at a current density of 5 A/dm$^2$ and an electricity quantity of 7200 coulomb in a plating solution shown in Table 11. The hydrogen overvoltage of the obtained electrode was 280 mV as measured at 90° C. and 30 A/dm$^2$ in 11N NaOH. The Ni content in the active substance as 24%.

TABLE 11

| | |
|---|---|
| $SnCl_2.2H_2O$ | 30 g/l |
| $NiCl_2.6H_2O$ | 300 g/l |
| NaCl | 130 g/l |
| HCl | 10 vol. % |
| Bath temperature | 65° C. |

EXAMPLE 11

The plating operation was carried out at 10 A/dm$^2$ for 12 minutes in the same manner as described in Examples 1 through 3 except that particles of tungsten carbide having an average particle size of 0.5μ were added at a concentration of 30 g/l according to the teaching of Japanese Patent Application Laid-Open Specification No. 133484/81. The hydrogen overvoltage of the obtained electrode was 90 mV as measured at 90° C. at a current density of 30 A/dm$^2$ in 11N NaOH. The nickel content in the obtained electrode was 50% by weight as Ni/(Ni+Sn).

EXAMPLES 12 THROUGH 14

The plating operation was carried out at an electricity quantity of 7200 coulomb in the same manner as described in Examples 1 through 3 except that 33 g/l of nickel sulfate ($NiSO_4.6H_2O$) was added instead of 30 g/l of nickel chloride ($NiCl_2.6H_2O$). The hydrogen overvoltage of the obtained electrode was measured at 90° C. at a current density of 30 A/dm$^2$ in 11N NaOH. The obtained results are shown in Table 12.

TABLE 12

| Example No. | Plating Current Density (A/dm$^2$) | Hydrogen Overvoltage (mV) | Thickness (μ) of Active Layer | Ni Content (% by weight |
|---|---|---|---|---|
| 12 | 5 | 120 | 32 | 48 |
| 13 | 10 | 105 | 25 | 50 |
| 14 | 19 | 120 | 20 | 56 |

EXAMPLE 15

An expanded metal (SW=3 mm, LW=6 mm, thickness=1.5 mm) of soft steel, which had been degreased and etched, was plated at 5 A/dm$^2$ for 5 minutes in a dispersion plating bath shown in Table 13 according to the teaching of Japanese Patent Application Laid-Open Specification No. 133484/81. Then, a butanol solution containing $NiCl_2.6H_2O$ and $SnCl_2.2H_2O$ at predetermined concentrations was coated on the so-treated substrate so that the total amount supported of nickel and tin was 1.7 mg/cm$^2$ when the thermal decomposition was repeated 5 times. The thermal decomposition was carried out at 330° C. in an atmosphere of nitrogen gas ($N_2$) while changing the nickel content as indicated in Table 14. The hydrogen overvoltage of the obtained electrode was measured at 90° C. at a current density of 30 A/dm$^2$ in 11N NaOH. The obtained results are shown in Table 14.

TABLE 13

| Ingredients | Concentrations |
|---|---|
| $NiSO_4.6H_2O$ | 250 g/l |
| $NiCl_2.6H_2O$ | 45 g/l |
| $H_3BO_3$ | 30 g/l |
| WC (tungsten carbide) (average | 30 g/l |

TABLE 13-continued

| Ingredients | Concentrations |
|---|---|
| particle size = 0.5μ) | |

TABLE 14

| Run No. | Ni Content (% by weight) | Sintering Temperature | Sintering Atmosphere | Hydrogen Overvoltage (mV) |
|---|---|---|---|---|
| 1 | 95 | 330° C. | $N_2$ | 170 |
| 2 | 80 | 330° C. | $N_2$ | 150 |
| 3 | 60 | 330° C. | $N_2$ | 155 |
| 4 | 50 | 330° C. | $N_2$ | 195 |

EXAMPLE 16

The procedures of Example 15 were repeated in the same manner as described in Example 15 except that the sintering temperature was changed to 430° C. The obtained results are shown in Table 15.

TABLE 15

| Run No. | Ni Content (% by weight) | Sintering Temperature | Sintering Atmosphere | Hydrogen Overvoltage (mV) |
|---|---|---|---|---|
| 5 | 99 | 430° C. | $N_2$ | 195 |
| 6 | 95 | 430° C. | $N_2$ | 175 |
| 7 | 80 | 430° C. | $N_2$ | 140 |
| 8 | 60 | 430° C. | $N_2$ | 100 |
| 9 | 50 | 430° C. | $N_2$ | 110 |
| 10 | 35 | 430° C. | $N_2$ | 190 |

COMPARATIVE EXAMPLE 4

The procedures of Example 15 were repeated in the same manner except that the Ni content in the Ni-Sn alloy was changed to 15% by weight and the sintering temperature was adjusted to 330° C. or 430° C. The obtained results are shown in Table 16.

TABLE 16

| Run No. | Ni Content (% by weight) | Sintering Temperature | Sintering Atmosphere | Hydrogen Overvoltage (mV) |
|---|---|---|---|---|
| 11 | 15 | 330° C. | $N_2$ | 350 |
| 12 | 15 | 430° C. | $N_2$ | 280 |

EXAMPLE 17

The procedures of Example 16 were repeated in the same manner except the sintering was carried out in a hydrogen atmosphere. The obtained results are shown in Table 17.

TABLE 17

| Run No. | Ni Content (% by weight) | Sintering Temperature | Sintering Atmosphere | Hydrogen Overvoltage (mV) |
|---|---|---|---|---|
| 13 | 95 | 430° C. | $N_2$ | 165 |
| 14 | 80 | 430° C. | $H_2$ | 130 |
| 15 | 60 | 430° C. | $H_2$ | 100 |
| 16 | 50 | 430° C. | $H_2$ | 100 |
| 17 | 35 | 430° C. | $H_2$ | 180 |

We claim:

1. A reduced hydrogen overvoltage cathode comprising an electrically conductive electrode substrate and an active layer of an alloy of nickel and tin on the substrate, wherein the alloy of nickel and tin adheres to the substrate in the form of a plurality of substantially spherical crystalline nodules and the nickel content in the active layer is 25 to 99% by weight.

2. A cathode as set forth in claim 1, wherein the thickness of the active layer is 0.1 to 150$\mu$.

3. The cathode of claim 1 wherein the hydrogen overvoltage is less than 200 millivolts at a current density of 30 A/dm$^2$.

4. The cathode of claim 1 wherein the nickel content in the active layer is 45 to 80% by weight.

5. The cathode of claim 1 wherein the active layer of nickel and tin alloy is formed by co-electroplating of nickel and tin onto the substrate from a solution of soluble nickel salts, tin salts and a complexing agent which is capable of forming a complex with nickel or tin and has the property of bringing the electrodeposition potential of the nickel ion and the tin ion close to each other.

6. The cathode of claim 5 wherein the soluble nickel salts are selected from the group consisting of nickel chloride, nickel sulfate, nickel nitrate, nickel bromide, nickel acetate, nickel ammonium sulfate, nickel sulfamate, nickel lactate and nickel benzene sulfate.

7. The cathode of claim 5 wherein the soluble tin salts are selected from the group consisting of stannous chloride, stannous nitrate, stannous sulfate, stannous pyrophosphate and stannic sulfate.

8. The cathode of claim 1 wherein the hydrogen overvoltage is less than 120 millivolts at a current density of 30 A/dm$^2$.

9. The cathode of claim 5 wherein the molar ratio Sn/Ni of the tin ion to the nickel ion in the plating solution is $10^{-4}$ to 2.

10. The cathode of claim 9 wherein the active layer of nickel and tin alloy is electroplated at a current density of 0.1 to 30 A/dm$^2$, and the current density is decreased in said range when the molar ratio Sn/Ni of the tin ion to the nickel ion in the plating solution is small and the current density is increased in said range when said molar ratio is large.

11. The cathode of claim 5 wherein said complexing agent is selected from the group consisting of amino acids, amines, hydroxycarboxylic acids, hydroxysulfonic acids and aminosulfonic acids.

12. The cathode of claim 11 wherein said amino acid is selected from the group consisting of glycine, $\alpha$-alanine, $\beta$-alanine, valine, aspartic acid, glutamic acid, alginic acid, lysine, histidine, proline, serine and threonine.

13. The cathode of claim 11 wherein said amine is selected from the group consisting of pyridine, pyrazole and ethylene diamine.

14. The cathode of claim 11 wherein said hydroxycarboxylic acid is selected from the group consisting of citric acid, tartaric acid and salts thereof.

15. The cathode of claim 11 wherein said hydroxysulfonic acid is selected from the group consisting of cresol-sulfonic acid and salts thereof.

16. The cathode of claim 11 wherein said aminosulfonic acid is selected from the group consisting of sulfamic acid and salts thereof.

17. The cathode of claim 11, wherein said complexing agent is present in an amount of 0.1 to 5 moles per mole of the complex-forming metal ion.

18. The cathode of claim 17, wherein said complexing agent is present in an amount of 0.5 to 3 moles per mole of the complex-forming metal ion.

19. The cathode of claim 5 wherein said complexing agent is present in an amount of 0.1 to 5 moles per mole of the complex-forming metal ion, and said complexing agent is selected from the group consisting of thiourea, xanthic acid, sodium fluoride, hydrofluoric acid, sodium chloride and hydrochloric acid.

* * * * *